United States Patent [19]

Nozawa et al.

[11] 4,371,098

[45] Feb. 1, 1983

[54] ATOMIZER USABLE IN BOTH NORMAL AND INVERTED ORIENTATIONS

[75] Inventors: Takamitsu Nozawa; Takao Kishi; Minoru Hinokiyama, all of Tokyo, Japan

[73] Assignee: Yoshino Kogyosho Co., Ltd., Tokyo, Japan

[21] Appl. No.: 191,336

[22] PCT Filed: Jun. 6, 1979

[86] PCT No.: PCT/JP79/00142

§ 371 Date: Jan. 11, 1980

§ 102(e) Date: Jan. 11, 1980

[87] PCT Pub. No.: WO80/00011

PCT Pub. Date: Jan. 10, 1980

[30] Foreign Application Priority Data

| | | | |
|---|---|---|---|
| Jun. 7, 1978 | [JP] | Japan | 53-77746[U] |
| Nov. 7, 1978 | [JP] | Japan | 53-153522[U] |
| Nov. 30, 1978 | [JP] | Japan | 53-164781[U] |

[51] Int. Cl.[3] ..... B05E 9/043

[52] U.S. Cl. ..... 222/321; 222/376; 222/464; 239/342; 137/853

[58] Field of Search ..... 222/376, 382, 402.19, 222/464, 321, 383; 239/333, 342

[56] References Cited

U.S. PATENT DOCUMENTS

| | | | |
|---|---|---|---|
| 403,042 | 5/1889 | Frayer | 222/376 X |
| 994,938 | 6/1911 | Larimore | 222/376 |
| 1,325,134 | 12/1919 | Anthes | 222/376 |
| 2,531,980 | 11/1950 | Johnson | 222/376 |
| 3,542,254 | 11/1970 | Samuelson et al. | 222/402.19 |
| 3,893,596 | 7/1975 | Beres et al. | 222/402.19 |

*Primary Examiner*—David A. Scherbel
*Assistant Examiner*—Frederick R. Handren

[57] ABSTRACT

The present invention is concerned with an atomizer usable in both normal and inverted orientations, in which only the liquid to be atomized is sucked up into a pressurizing chamber 7 of a pump mechanism, while completely avoiding the flow of air into the pressurizing chamber, in both the normal and inverted orientations. The sucking of only the liquid is achieved by use of a suction passage 15 for operation in the inverted orientation provided in an ordinary pump mechanism 2, the suction passage 15 being opened at its one end to the pressurizing chamber and at its other end to a space outside and above the pump mechanism, and a stop valve 13A disposed in the suction passage 15 and adapted to open when the vacuum in the pressurizing chamber has been increased beyond a predetermined level, in the operation in inverted orientation.

9 Claims, 9 Drawing Figures

ATOMIZER USABLE IN BOTH NORMAL AND INVERTED ORIENTATIONS

TECHNICAL FIELD

The present invention relates to an atomizer usable in both normal and inverted orientations, capable of reliably preventing flow of air from coming into a pressurizing chamber in both orientations.

BACKGROUND OF THE PRIOR ART

Hitherto, there has been proposed an atomizer having two suction pipes connected to the suction port of a pump mechanism and leading to the neck and bottom portions of a liquid vessel so that the atomizer may be used in both normal (upright) and inverted orientations. In this type of atomizer, the neck portion of the liquid vessel has to have a diameter large enough to allow two suction pipes to pass therethrough. If the diameter of the neck portion is too small, it is not possible to stably support the atomizer at the center of the neck portion, and as a result, the atomizer is held in an unstable manner which hinders a smooth atomizing manipulation.

In this type of atomizer, the switching valve for switching the suction passage between two suction pipes is mounted separately from the suction pipes, undesirably restricting the space in the liquid vessel.

The inventors of the present invention have experimentarily produced an atomizer usable in normal and inverted orientations in which the suction port for operation in the inverted orientation is provided at the upper portion of the cylinder of the pump mechanism. In this case, the liquid is sucked from the suction port for operation in the inverted orientation only after a piston has been fully reset to maximize the pressurizing chamber, so that it is necessary to construct the pump mechanism to have a strength to withstand a large vacuum. In addition, with this arrangement, it has been difficult to suck a sufficiently large amount of liquid into the pressurizing chamber.

BRIEF SUMMARY OF THE INVENTION

It is therefore a major object of the invention to provide an atomizer usable in both normal and inverted orientations having a liquid suction valve and an air-sucking prevention valve for both orientations, the valve being incorporated in the pump mechanism to ensure the suction of sufficiently large amounts of liquid in operations in both orientations.

It is another object of the invention to avoid increasing the size of the atomizer, so as not to restrict the space in the liquid vessel.

It is still another object of the invention to form the suction passage for operation in the inverted orientation by means of an outer sleeve provided around the cylinder of the pump mechanism, thereby to reduce the outside diameter of the upper portion of the cylinder and to make it possible to support the pump mechanism at the center of the neck of the liquid vessel.

DETAILED DESCRIPTION OF THE INVENTION

Figure 1A:
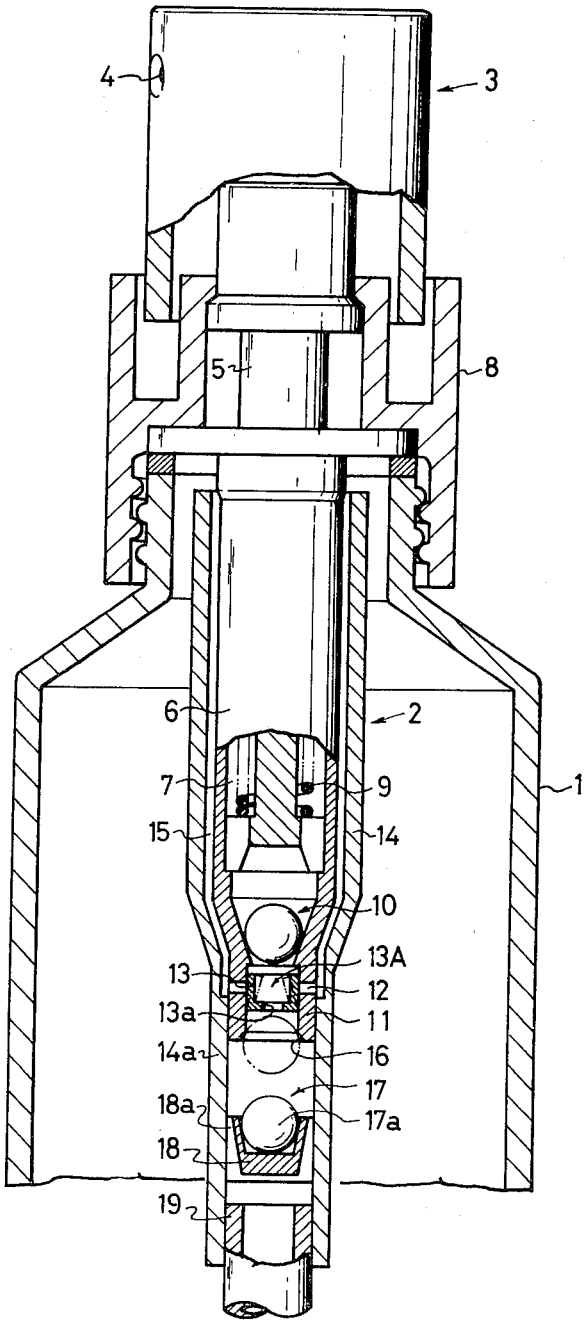
FIG. 1A is a partial vertical sectional view of an atomizer usable in both normal and inverted orientations, in accordance with a first embodiment of the invention.

A first embodiment of the invention will be described hereinunder with specific reference to FIGS. 1A and 1B.

A pump mechanism 2 is attached to the neck portion of a liquid vessel 1. An atomizing head 3 is provided above the pump mechanism 2. The atomizing head 3 is provided with an atomizing nozzle 4, and is attached to the upper end of a plunger 5 which plays the double role of a piston for the pump mechanism 2 and a passage for the liquid.

The pump mechanism 2 has a pressurizing chamber 7 defined by the plunger 5 and a cooperating cylinder 6. The cylinder 6 is suspended into the liquid vessel 1 and is connected at its upper end detachably to the mouth portion of the liquid vessel 1 by means of a screw sleeve 8. Also, a coiled spring 9 for upwardly urging the plunger is disposed in the cylinder 6. The plunger 5 is inserted into the cylinder 6 from the upper side of the latter, overcoming the force of the spring 9, and is slidable in the cylinder 6.

The cylinder 6 is provided at its lower part with a suction valve 10, while a discharge valve (not shown) is provided in the upper part of the plunger 5. Further, a small sleeve 11 is formed unitarily with the lower end of the cylinder 6.

With this arrangement, it is possible to pressurize the liquid in the pressurizing chamber 7 to forcibly open the discharge valve to atomize the liquid from the nozzle 4, by a depression of the atomizer head 3. This arrangement has heretofore been widely known and used.

If the internal pressure is neglected, various types of valves which can close and open the passage in the normal and inverted modes of operation, e.g., a ball valve, a tongue-like valve and so forth, can be used as the suction valve. The suction valve 10 may be disposed at the upper part of the cylinder 6 as required, although in the described embodiment the suction valve 10 is disposed at the lower portion of the cylinder 6.

Several transverse bores 12 are formed at the intermediate portion of the small sleeve 11. These bores 12 are adapted to cooperate with an annular valve body 13 made of an elastic material such as soft plastic or rubber, received by the small sleeve 11. The valve body 13 and the bores 12 in combination constitute a stop valve 13A. The valve body 13 has a lower base end. An inwardly directed flange 13*a* is provided to prevent the valve body 13 from being deflected at the lower base end.

During operation of the atomizer in normal orientation, the valve body 13 closes the bores 12 to prevent any air from being sucked through a later-mentioned suction passage used when operating in the inverted mode.

On the other hand, during the operation of the atomizer in the inverted mode, the ball valve 17*a* of a later-mentioned air-sucking prevention valve 17 closes the tapered valve seat 16. Therefore, when the vacuum in the pressurizing chamber exceeds a predetermined level, the upper portion of the valve body 13 is bent inwardly to open the transverse bores 12.

A sleeve 14 is disposed to surround the cylinder 6. In the inner peripheral surface of this sleeve 14, there is formed a suction passage 15 for operation in the inverted mode, the passage being in the form of a groove which leads from the upper part of the liquid vessel 1 to the transverse bore 12 of the small sleeve 11. The passage 15 in FIG. 1A may be a groove provided on the sleeve 14, or it may be formed as an annular clearance between the outer surface of the pump cylinder 6 and the inner surface of the sleeve 14. The sleeve 14 has a lower cylindrical portion 14*a* which projects downwardly from the lower end of the cylinder 6, and is attached to a small sleeve 11 with the lower cylindrical portion 14*a* receiving the latter.

The lower end of the small sleeve 11 is formed as a downwardly and outwardly directed tapered valve seat 16. A ball valve 17*a* is inserted into cylindrical portion 14*a* at the lower side of the tapered valve seat so as to constitute an air-sucking prevention valve 17 during operation in the inverted mode. The ball valve 17*a* is prevented from dropping by a saucer member 18 provided in the lower cylindrical portion 14*a*. A plurality of grooves 18*a* are formed in the outer peripheral surface of the saucer member 18. A suction pipe 19 leading to the bottom of the liquid vessel 1 is fitted to the lower end of the lower cylindrical member 14*a*. Therefore, when the pressure in the pressurizing chamber 7 is reduced to a vacuum in the normal orientation of the atomizer, the liquid flows into the pressurizing chamber 7 through the suction pipe 19, grooves 18*a*, valve body 13 and the suction valve 10. In this case, the ball valve does not close the tapered valve seat 16, because the liquid flows outside the saucer member 18.

Figure 1B:
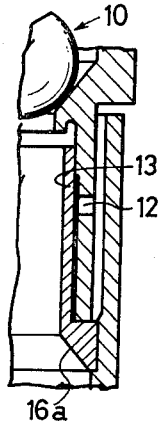
FIG. 1B is a sectional view of an essential part of the atomizer, showing particularly a modification of a stop valve provided in the liquid sucking passage for operation in the inverted mode.

It is possible to form the tapered valve seat 16*a* by projecting the lower end of the valve body 13 from the lower end of the small sleeve 11 as shown in FIG. 1B, instead of providing the tapered valve seat 16 on the lower end of the small sleeve 11.

The atomizer usable in both normal and inverted modes having the described construction operates in the manner described hereinunder.

As the atomizing head 3 is depressed in the normal orientation of the atomizer, the plunger 5 of the pump mechanism 2 is lowered. Since the suction valve 10 is closed, the liquid in the pressurizing chamber 7 is pressurized, so that the liquid is forwarded through the discharge valve (not shown) to the atomizing nozzle 4 so as to be atomized from the latter. The discharge valve is automatically closed as the pressure in the pressurizing chamber comes down to cease the atomization.

Then, as the atomizing head 3 is released, the plunger 5 and the atomizing head 3 are lifted by the spring 9 so as to reduce the pressure in the pressurizing chamber 7 down to a vacuum. As a result, the suction valve 10 is opened to allow the sucking of liquid through the suction pipe 19, groove 18 and the valve body 13.

During this sucking operation, the ball valve 17*a* does not abut the tapered valve seat 16, because the ball valve 17*a* is placed due to its weight on the saucer member 18 so as to make the liquid flow through the outer peripheral groove 18*a* of the saucer member 18. The vacuum established within the valve body 13 is slightly greater than that at the outside of the same. However, since the air-sucking prevention valve 17 is kept in the opened state, the transverse bore 12 is never opened by the valve body 13, in contrast to the case of operation in the inverted orientation which will be described later, so that the air is prevented from flowing into the pressurizing chamber 7.

When operating in the inverted mode, the liquid in the pressurizing chamber 7 is pressurized to close the suction valve 10, as the atomizing head 3 is pressed. As the atomizing head 3 is further pressed, a high pressure is established in the pressurizing chamber 7 so that the discharge valve is forcibly opened to allow the liquid to be atomized from the atomizer nozzle 4. The discharge valve is closed automatically as the pressure in the pressurizing chamber comes down, and the atomization is ceased.

As the atomizing head 3 is released, the plunger 5 is returned by the force of the spring 9. However, the ball valve 17*a* of the air-sucking prevention valve 17 abuts the tapered valve seat 16 due to the force of gravity. Also, the suction valve 10 has been opened. Therefore, the spaces in the pressurizing chamber 7 and the valve body 13 is evacuated to make the valve body 13 open the transverse bores 12, so as to permit liquid flow into the pressurizing chamber 7 through the suction passage 15 for inverted operation and through the transverse bores 12. Since the air-sucking prevention valve 17 is kept closed, air is prevented from being sucked into the pressurizing chamber 7 through the suction pipe 19, although in this state the latter is exposed to the air. The aforementioned atomization is performed as the atomizing head 3 is pressed subsequently.

As has been described, in the atomizer usable in both modes in accordance with the invention, a suction valve 10 for operation in the normal orientation, a valve body 13 which acts as an air-sucking prevention valve and a suction valve in operations in the normal and inverted orientations, respectively, and an air-sucking prevention valve 17 for operation in the inverted orientation, are provided at the lower part of the pump mechanism 2, so that air is prevented without fail from flowing into the pressurizing chamber 7 in operation in either orientaion, to ensure the sucking of the liquid solely.

The suction valve 10, valve body 13, and the air-sucking prevention valve 17 for enabling the atomizer to perform an atomization in both the normal and inverted orientations are arrayed in series and disposed at the lower part of the pump mechanism 2, so that they never restrict the space in the liquid vessel. Further, by adding the valve body 13, sleeve 14 and the air-sucking prevention valve 17 to an ordinary atomizer, the atomizer becomes operative also in the inverted orientation.

The suction passage 15 for operation in inverted orientation is formed by a sleeve 14 fitted around the cylinder 6 of the pump mechanism 2. It is, therefore, not necessary to employ a large diameter at the upper part of the pump mechanism. Therefore, the pump mechanism 2 can easily be attached to the neck of the liquid vessel and to support the pump mechanism 2 stably at the center of the neck of the liquid vessel, even when the latter has a small diameter.

Figure 2A:
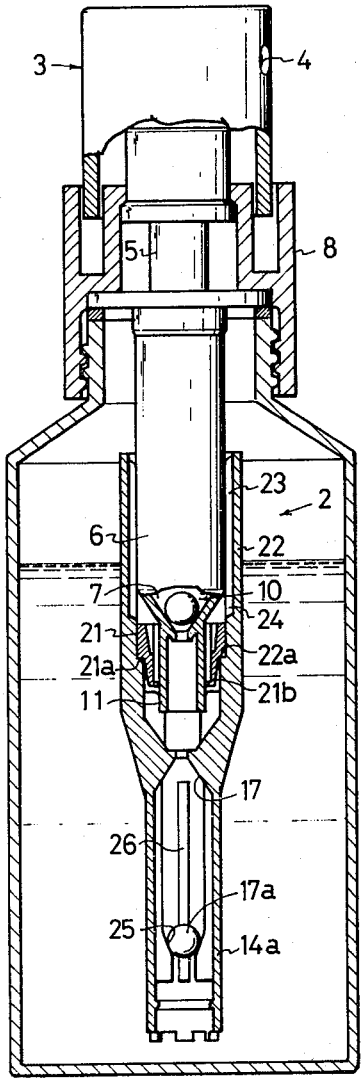
FIG. 2A is a vertical sectional view of an atomizer usable in both normal and inverted orientations, in accordance with a second embodiment of the invention.

Hereinafter, a second embodiment of the invention will be described with specific reference to FIGS. 2A to 2D. In this embodiment, the annular valve body 13 constituting the stop valve 13A in the first embodiment is replaced by an annular valve body 21 provided on the outer periphery of the small sleeve 11 of the cylinder 6. Referring first to FIG. 2A, the central step portion 21*a* of annular valve body 21 is kept in contact with the stepped portion 22*a* on the inner peripheral surface of a sleeve 22 provided around the cylinder 6, thereby to secure the valve body 21 to the inside of the sleeve 22. Then, the valve member 21 is fitted around the cylinder 6 from the lower side of the latter. After this fitting, a liquid passage is formed in the inner surface of the valve body 21 and outside of the small sleeve 11 of the cylinder. In addition, a plurality of ribs 23 formed on the inner peripheral surface of the sleeve 22 at a suitable interval are fitted to the cylinder 6 thereby to fix the sleeve 22 to the pump mechanism 2. Suction passages 24 for operation in the inverted orientation are formed between adjacent ribs 23 and are communicated with the pressurizing chamber 7 through the lower chamber of the small sleeve 11.

The valve body 21 is fixed at its upper portion to the inner peripheral surface of the sleeve 22, while the lower part of the same is formed into a swingable part 21*b* which closely contact the small sleeve 11 of the cylinder 6 in an airtight manner.

Also, the air-sucking prevention valve 17 in the first embodiment is formed in the second embodiment as follows. Namely, in this second embodiment, the saucer member 18 in the first embodiment is omitted, and a support portion 25 for the ball valve 17*a* is provided in the lower part 14*a* of the sleeve 14. At the same time, the valve seat 17*b* for the ball valve 17*a* is formed at the upper part of the lower portion 14*a*. Further, a groove-like liquid passage 26 is formed in the inner wall of the lower portion 14*a*.

The portions of the second embodiment other than described above are identical to those of the first embodiment, and the atomizer of this second embodiment operates substantially in the same manner as the first embodiment in both normal and inverted orientations for sucking the liquid into the pressurizing chamber and for preventing the air from flowing into the pressurizing chamber. Also, this second embodimemt brings about an advantage equivalent to that of the first embodiment.

The swingable part 21*b* of the cylindrical valve body 21 is adapted to be deflected downwardly at its end to open the suction passage 24, only when the pressure in the pressurizing chamber 7 is lowered to a vacuum during operation in the inverted mode.

Figure 2B:
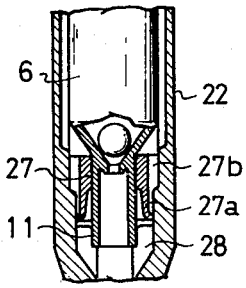
FIGS. 2B and 2C are a partial sectional view and a partial perspective view of an essential part of the atomizer of the second embodiment, showing particularly a modification of the stop valve disposed in the suction passage for operation in the inverted mode.
Figure 2C:
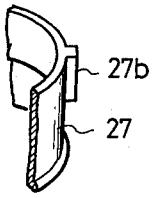

FIGS. 2B and 2C show a modification of the cylindrical valve body 21 in the second embodiment. In this modification, an annular valve body 27 is fitted and fixed to the small sleeve 11 of the cylinder 6, and a swingable part 27*a* is formed at the lower peripheral part of the valve body 27 so as to contact the inner peripheral surface of the sleeve 22 in a sealing manner. In addition, a plurality of ribs 27*b* are formed on the periphery of the upper part of the valve body 27, so as to form liquid passages between the valve body 27 and the sleeve 22. The sleeve 22 is provided at its inside with ribs 28 for strengthening the coupling between itself and the small sleeve 11.

Figure 2D:
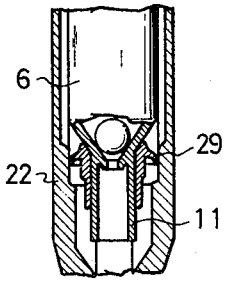
FIG. 2D is a partial perspective view of an essential part of a stop valve showing stil another modification.

FIG. 2D shows another modification of the valve member 27 of the second embodiment. In this case, the swingable part 27*a* of the valve member 27 shown in FIG. 2B is formed as a laterally extending swingable part 29 adapted to make a sealing contact at its periphery with the inner peripheral wall of the sleeve 22.

Figure 3:
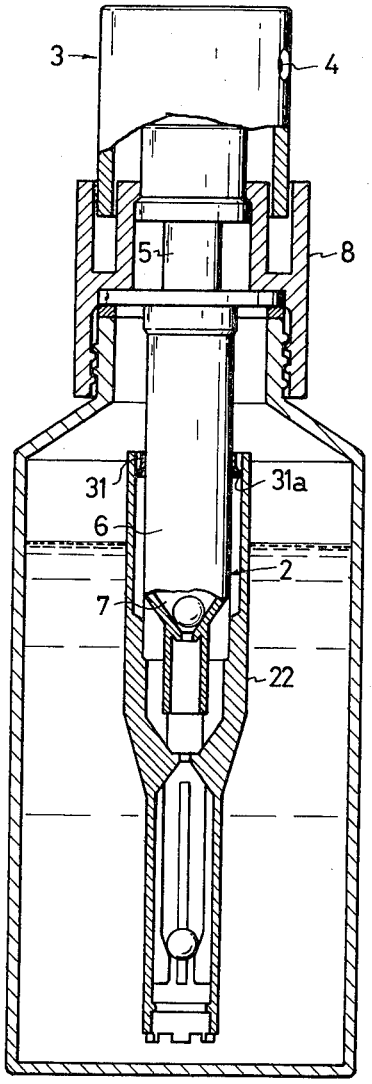
FIG. 3 is a vertical sectional view of an atomizer usable in both normal and inverted orientation in accordance with a third embodiment of the invention.

Hereinafter, a third embodiment of the invention will be described with reference to FIG. 3. In this third embodiment, the annular valve body 13 in the first embodiment is replaced with annular valve body 31 provided at the periphery of upper part of the cylinder 6. The valve body 31 of this embodiment has a base portion fitted and fixed to the upper peripheral part of the cylinder 6 of the pump mechanism 2. The lower portion of the valve body 31 is formed into a skirt 31*a* which spreads outwardly, and the end of the skirt 31*a* makes a sealing contact with the inner peripheral surface of the sleeve 22.

Other portions of this third embodiment than described are identical to those of the second embodiment, and the atomizer of this third embodiment can perform a safe sucking of liquid into the pressurizing chamber, while preventing air from coming into the pressurizing chamber, in both normal and inverted orientations, as is the case of the first embodiment.

Figure 4:
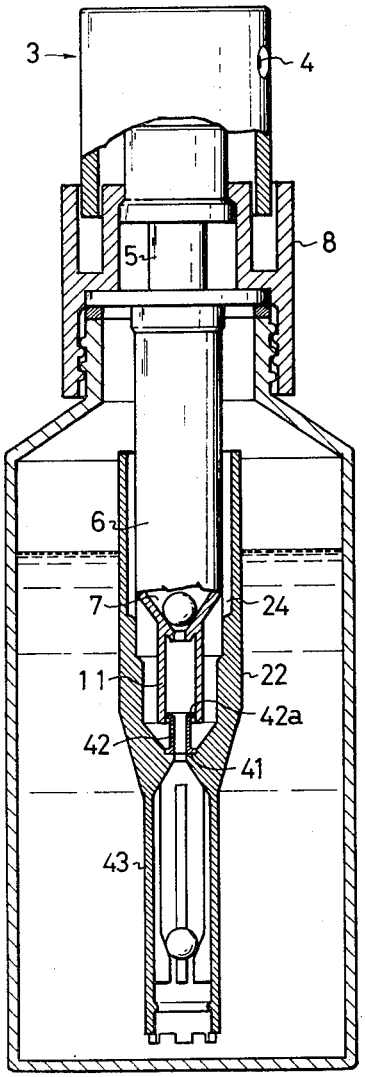
FIG. 4 is a vertical sectional view of an atomizer usable in both normal and inverted orientations in accordance with a fourth embodiment of the invention.

FIG. 4 shows a fourth embodiment of the invention in which the cylindrical valve body 21 as used in the second embodiment is replaced by a cylindrical shaped valve body 42 disposed between the small sleeve 11 of the cylinder 6 and an intermediate supporting bottom member provided in the sleeve 22 at a portion of the latter above the valve seat 17*b*. The cylindrical valve body 42 of this embodiment has a base attached to the intermediate supporting bottom 41, while an upper sealing portion 42*a* thereof is received by the small sleeve 11.

Therefore, the pressurizing chamber 7 is brought into communication with the suction passage 24 for operation in the inverted orientation as the sealing portion 42*a* is deflected inwardly. When the sealing portion 42*a* is not deflected, the liquid suction pipe extending downwardly from the sleeve 22 is communicated with the pressurizing chamber 7 through the central bore of the cylindrical valve body 42.

Other portions than described above are materially identical to those of the second embodiment, and the atomizer of this fourth embodiment can suck the liquid into its pressurizing chamber 7, in both normal and inverted orientations, while preventing the air from coming into the pressurizing chamber 7.

Figure 5:
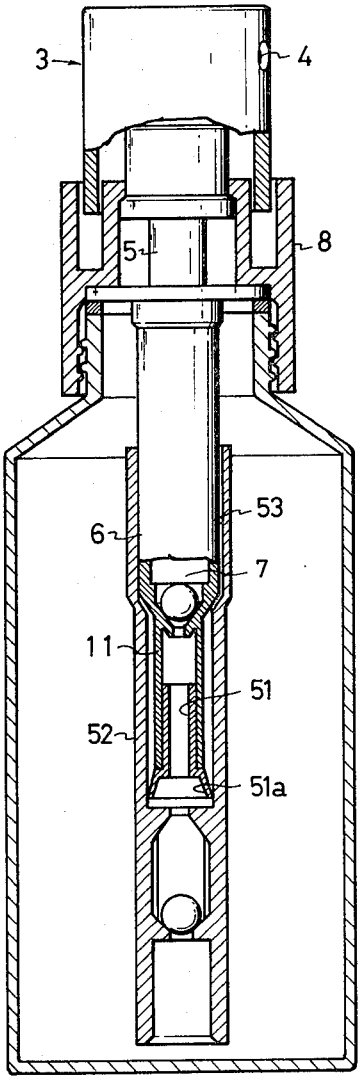
FIG. 5 is a vertical sectional view of an atomizer usable in both normal and inverted orientations in accordance with a fifth embodiment of the invention.

FIG. 5 shows a fifth embodiment of the invention in which the cylindrical valve body 42 as used in the fourth embodiment is replaced by a cylindrical shaped valve body 51 held in the small sleeve 11 of the cylinder 6. The cylindrical valve body 51 has an upper base end which is fixedly fitted to the inside of the small sleeve 11, while a lower skirt portion 51*a* of the same makes a sealing contact with the inner peripheral surface of a sleeve 52. The sleeve 52 is adapted to fit and support the cylinder 6, and has a substantially constant outside diameter over its length. The suction passage 53 for the operation in inverted mode is formed only at one side of upper part of the sleeve 52.

Other portions of this fifth embodiment are identical to those of the second embodiment.

In this fifth embodiment, the pressurizing chamber 7 is communicated with a passage 53 for operation in inverted orientation, when the skirt portion 51*a* is deflected inwardly. The atomizer of this fifth embodiment, therefore, can suck the liquid into the pressurizing chamber thereof, while preventing the air from coming into the pressurizing chamber, in both modes of operation, and thus achieves the same advantage as the first embodiment.

We claim:

1. In an atomizer having an atomizing head, a first suction passage and associated first suction valve communicating with liquid in a liquid holding vessel, a discharge valve and a nozzle port for discharging liquid under pressure, and a pump mechanism including a cylinder means and a piston, said pump mechanism being adapted to be actuated by the vertical stroking of said atomizing head such that, when said atomizer head is moved upwardly, the pressure in a pressurizing chamber defined between said cylinder means and one end of said piston is decreased to a vacuum so as to allow a liquid to be sucked up from the vessel into said pressurizing chamber through said first suction passage and said first suction valve when said atomizer is operated in a normal orientation in which said atomizer is upright, while when said atomizing head is moved downwardly, a high pressure is established in said pressurizing chamber to forcibly open said discharge valve when the pressure in said pressurizing chamber has been increased beyond a predetermined level so as to allow said liquid to be atomized from said nozzle port in said atomizing head; the improvement comprising: a second suction passage extending upwardly inside the vessel from said first suction valve and communicating with the liquid in an inverted orientation of said atomizer; a second suction valve disposed in said second suction passage and adapted to open only when the pressure in said pressurizing chamber has been reduced down to a vacuum greater than a predetermined vacuum level, in the operation of said atomizer in said inverted orientation; and a check valve disposed in the first suction passage, said check valve being adapted to prevent air in said first suction passage from flowing into said pressurizing chamber when said atomizer is in the inverted orientation; and wherein said second suction valve is adapted to prevent air in said second suction passage from flowing into said pressurizing chamber when said atomizer is in the normal orientation.

2. The improvement in an atomizer as claimed in claim 1, wherein said second suction valve is a stop valve and includes: a transverse bore formed at a lower portion of said cylinder means; and a flexible annular valve body fitted to the inside of the portion of said cylinder means where said transverse bore is formed.

3. The improvement in an atomizer as claimed in claim 1, wherein said second suction valve includes: an opening formed at a lower portion of said cylinder means; and a flexible annular valve body fitted to the outside of said portion of said cylinder means where said opening is formed.

4. The improvememt in an atomizer as claimed in claim 1, further comprising: a sleeve fitted around said cylinder means of said pump mechanism such that said second suction passage for operation in the inverted orientation is formed between said sleeve and said cylinder means, said second section passage being opened at its upper end and communicated at its lower end with said pressurizing chamber in said cylinder means; said second suction valve formed by a resilient annular valve member disposed between said cylinder means and said sleeve so as to change said second suction passage, for operation in the inverted orientation, between the opened state and the closed state.

5. The improvement in an atomizer as claimed in claim 1, further comprising: a sleeve fitted around said cylinder means of said pump mechanism so as to define therebetween said second suction passage for operation in inverted orientation; and a small sleeve member formed to project from the lower end of said cylinder means, said second suction passage being opened at its upper end and communcated at its lower end with the space in said small sleeve member; said second suction valve formed by a resilient annular valve body disposed between the lower end of said small sleeve member and said sleeve and adapted to change said second suction passage, for operation, in the inverted orientation, between the open state and the closed state.

6. In a pressure accumulation type atomizer having a pump mechanism including a cylinder and a piston, said pump mechanism being adapted to be actuated by the vertical stroking of an atomizing head such that, when said atomizing head is moved upward, the pressure in a pressurizing chamber defined between said piston and said cylinder is decreased to a vacuum so as to allow a liquid to be sucked up from a liquid vessel into said pressurizing chamber through a suction valve for operation in a normal orientation in which said atomizer is upright, while, when said atomizing head is moved downward, a high pressure is established in said pressurizing chamber to forcibly open a discharge valve when the pressure has been increased beyond a predetermined level so as to allow said liquid to be atomized from a nozzle port in said atomizing head; the improvement comprising: a suction passage for operation in said inverted orientation; a stop valve disposed in said suction passage and adapted to open only when the pressure in said pressurizing chamber has been reduced down to a vacuum greater than a predetermined vacuum level, in the operation of said atomizer in said inverted orientation; a sleeve fitted around said cylinder of said pump mechanism such that said suction passage for operation in the inverted orientation is formed between said sleeve and said cylinder, said suction passage being opened at its upper end and communicated at its lower end with said pressurizing chamber in said cylinder; said stop valve formed by a resilient annular valve member disposed between said cylinder and said sleeve so as to change said suction passage, for operation in the inverted orientation, between the opened state and the closed state.

7. The inprovement in an atomizer as claimed in claim 6, further comprising a downwardly extending suction passage connected to the lower end of said cylinder and a check valve disposed in said downwardly extending suction passage for operation in the normal orientation, said check valve being adapted to prevent air from flowing into said pressurizing chamber when said atomizer is in the inverted orientation.

8. In a pressure accumulation type atomizer having a pump mechanism including a cylinder and a piston, said pump mechanism being adapted to be actuated by the vertical stroking of an atomizing head such that, when said atomizing head is moved upward, the pressure in a pressurizing chamber defined between said piston and said cylinder is decreased to a vacuum so as to allow a liquid to be sucked up from a liquid vessel into said pressurizing chamber through a suction valve for operation in a normal orientation in which said atomizer is upright, while, when said atomizing head is moved downward, a high pressure is established in said pressurizing chamber to forcibly open a discharge valve when the pressure has been increased beyond a predetermined level so as to allow said liquid to be atomized from a nozzle port in said atomizing head; the improvement comprising: a suction passage for operation in said inverted orientation; a stop valve disposed in said suction passage and adapted to open only when the pressure in said pressurizing chamber has been reduced down to a vacuum greater than a predetermined vacuum level, in the operation of said atomizer in said inverted orientation; a sleeve fitted around said cylinder of said pump mechanism so as to define therebetween said suction passage for operation in inverted orientation, said suction passage being opened at its upper end and communicated at its lower end with the space in a small sleeve member which is formed to project from the lower end of said cylinder; said stop valve formed by a resilient annular valve body disposed between the lower end of said small sleeve member and said sleeve and adapted to change said suction passage, for operation in the inverted orientation, between the opened state and closed state.

9. The improvement in an atomizer as claimed in claim 8, further comprising a downwardly extending suction passage connected to the lower end of said cylinder and a check valve disposed in said downwardly extending suction passage for operation in the normal orientation, said check valve being adapted to prevent air from flowing into said pressurizing chamber when said atomizer is in the inverted orientation.

* * * * *